US006045865A

United States Patent [19]

Felby et al.

[11] Patent Number: 6,045,865

[45] Date of Patent: Apr. 4, 2000

[54] PROCESS FOR IMPREGNATING SOLID WOOD AND PRODUCT OBTAINABLE BY THE PROCESS

[75] Inventors: Claus Felby, Herlev; Tomas Tage Hansen, Allerod, both of Denmark

[73] Assignee: Novo Nordisk A/S, Bagsvaerd, Denmark

[21] Appl. No.: 09/268,965

[22] Filed: Mar. 16, 1999

Related U.S. Application Data

[63] Continuation of application No. PCT/DK97/00439, Oct. 10, 1997.

[30] Foreign Application Priority Data

Oct. 11, 1996 [DK] Denmark ..... 1129/96
Nov. 15, 1996 [DK] Denmark ..... 1296/96

[51] Int. Cl.[7] ..... B05D 3/02; B05D 3/12

[52] U.S. Cl. ..... 427/297; 427/351; 427/369; 427/393; 427/397

[58] Field of Search ..... 427/297, 351, 427/369, 393, 397

[56] References Cited

U.S. PATENT DOCUMENTS 3,935,341 1/1976 Sorensen et al. ..... 427/317
4,303,705 12/1981 Kelso, Jr. ..... 427/351
4,567,115 1/1986 Trumble ..... 427/297

FOREIGN PATENT DOCUMENTS 0 389 216 9/1990 European Pat. Off. .
292864 8/1991 German Dem. Rep. .
284 836 11/1990 Germany .
3-183503 8/1991 Japan .
11-139905 5/1999 Japan .
95/07604 3/1995 WIPO .
95/09946 4/1995 WIPO .
96/03546 2/1996 WIPO .

OTHER PUBLICATIONS

A. Wagenfuhr, Abstract of DD 284386, Nov. 1990.
Abstract (Basic) of WO 98/24890, Jun. 1998.
Nicholas, ACS Symp. Ser. (1976; publ. 1977), 43, pp 33–46, 1977.

*Primary Examiner*—Erma Cameron
*Attorney, Agent, or Firm*—Steve T. Zelson, Esq.; Reza Green, Esq.

[57] ABSTRACT

The present invention relates to an enzymatic process for treating a solid wood or laminated solid wood article in a liquid medium containing an oxidase enzyme, an impregnating substance and an oxidizing agent so as to fixate the impregnating substance in the wood, thereby enhancing the effect of the impregnating substance.

16 Claims, No Drawings

PROCESS FOR IMPREGNATING SOLID WOOD AND PRODUCT OBTAINABLE BY THE PROCESS

CROSS-REFERENCE TO RELATED APPLICATIONS

This application is a continuation application of PCT/DK97/00439 filed Oct. 10, 1997, now WO98/16357 and claims priority under 35 U.S.C. 119 of Danish applications 1129/96 filed Oct. 11, 1996 and 1296/96 filed Nov. 15, 1996, the contents of which are fully incorporated herein by reference.

FIELD OF THE INVENTION

The present invention relates to an enzymatic process for treating wood-based articles, especially articles made of solid wood or laminated solid wood (e.g., blocks, posts, boards, planks, beams, joists, panels, sheets and the like) with a phenolic substance which, after fixation on and/or within the wood via the agency of the enzyme, confers one or more desired properties (e.g., improved resistance to rot, improved fire resistance, improved resistance to degradation by ultraviolet (UV) radiation and/or altered color) on the article in question.

BACKGROUND OF THE INVENTION

Current approaches to wood preservation on an industrial scale are based predominantly on the use of pressure and/or vacuum techniques for introducing especially fungicidal substances or other biocidal substances (possibly in combination with substances serving other functions, e.g., UV protectants) into certain woods, notably various species of pine (Pinus) and larch (Larix), as well as Douglas fir (*Pseudotsuga menziesii*; also known as Douglas pine, Douglas spruce, Oregon fir or Oregon pine), in which the cellular structure of the sapwood (alburnum) renders it receptive, under appropriate conditions, to impregnation with substances dissolved in liquid media. Heartwood, which often has a high content of natural resin (which itself normally confers a considerable degree of fungal rot resistance to the heartwood), is normally not accessible for impregnation to any significant extent.

Current industrial processes for impregnating wood may broadly be divided into two major classes, viz. pressure impregnation and vacuum impregnation.

In pressure impregnation processes, articles of wood (e.g., pine wood) to be impregnated are immersed, in an appropriate pressure vessel (tank or the like) in a solution comprising one or more impregnating substances dissolved in aqueous medium or in an organic solvent (depending on the nature of the impregnating substance(s)). The vessel is then pressurized (pressure typically in the range of about 1.5–10 bar), normally at a temperature in the range of 20–60° C., for a period of time (typically from 15 minutes to 2 hours) which is adequate to ensure satisfactory penetration of the impregnation solution into the wood.

In vacuum impregnation processes, articles of wood to be impregnated are normally first subjected, in an appropriate vessel, to a reduced pressure for a period of time, after which the impregnation solution is admitted directly to the vessel so as to equalize the pressure and result in submersion/immersion of the wood articles therein in the solution.

The reduced pressure employed will normally be a pressure slightly above that at which boiling of the impregnation solution will occur at the temperature in question. In the case, for example, of impregnation solutions based on toluene and/or xylenes as solvent, a pressure of about 6–8 kPa at ambient temperature is fairly typical.

As with pressure impregnation, immersion is continued for a period of time sufficient to ensure adequate penetration of the impregnation solution into the wood.

Typical aqueous impregnation media which have been employed in pressure or vacuum impregnation include aqueous solutions of water-soluble substances, particularly inorganic substances such as copper salts, chromium salts, arsenic compounds, phosphorus compounds, boron compounds and/or fluorides.

Typical non-aqueous impregnation media which have been employed in pressure or vacuum impregnation include solutions of organic substances {e.g., coal-tar fractions (such as "creosote oil"), or halogen-containing aromatic compounds, such as pentachlorophenol or "dichlofluanide", i.e., 1,1-dichloro-N-((dimethylamino)-sulfonyl)-1-fluoro-N-phenylmethane-sulfenamide)} and/or organometallic substances (e.g., tin compounds such as bis(tributyltin) oxide ("TBTO") and/or tributyltin naphthenate ("TBTN")) in organic solvents. The use of a number of organic substances which were previously widely used for impregnating wood, such as pentachlorophenol and certain coal-tar fractions, is now banned in numerous countries.

Both pressure and vacuum impregnation techniques have been widely used to treat ready-made wooden articles (e.g., posts, telephone poles, garden furniture, doors and door frames, windows and window frames, fencing, components for construction of harbors, piers, etc.). The choice of, and amount of, fungicidal impregnating substance(s)/medium used to impregnate a particular type of article depends largely on whether the article is to be permanently in contact with, or may be brought into prolonged contact with, soil (i.e. earth), water or sea water, or is to be exposed to less drastic conditions, such as ambient weather conditions (intermittent rain, snow, wind, etc.).

Current non-industrial approaches to wood preservation predominantly involve application to the wood—e.g., by painting, spraying or dipping—of water-based or organic solvent-based commercial preparations containing fungicides (e.g., certain of those mentioned above), waxes, pigments, UV filters and the like.

In the case, in particular, of many of the water-soluble fungicidal substances (e.g., copper salts, chromium salts and arsenic-containing salts) used to impregnate wood (particularly pine wood), it has widely been believed that the active substance(s) undergo strong fixation in the wood primarily via formation of essentially water-insoluble substances within the wood by reaction (e.g. metathesis) of the water-soluble, active components (usually ions) with substances (such as relatively high-molecular-weight anionic or cationic species) which are naturally present in the wood.

In the case of numerous impregnating substances (particularly fungicides) which are soluble in organic solvents, it appears to have been more or less assumed that fixation of the active substance(s) in wood is ensured as a result of the essential insolubility thereof in aqueous media (e.g. rain water).

There is growing environmental concern in relation, in particular, to the use of non-biodegradable, toxic and/or ecologically damaging substances, such as heavy metal species (e.g., copper, chromium or tin species) and arsenic-containing species, as biocides for wood impregnation. In this connection there is now weighty evidence to indicate that fixation of, for example, arsenic-containing fungicidal species in wood (notably pine wood) is poor, and that significant leaching of these and other impregnating agents from impregnated wood can occur under some of the conditions (e.g. frequent exposure to rainfall, prolonged submersion in water and/or prolonged contact with moist soil) to which wood treated in this manner is frequently exposed.

Likewise, there is growing pressure to limit the use of numerous types of organic solvents, particularly hydrocarbon-type solvents such as those (e.g., toluene or xylenes) often employed in impregnation processes.

There is thus an increasingly pressing need for alternative methods and systems which can provide satisfactory protection of wood-based products against various forms of degradation, but which—as far as possible—avoid the undesirable environmental consequences associated with current approaches to wood preservation.

The present invention makes a significant contribution to the fulfilment of this need. Additionally the invention provides a new process for adding and fixating color(s) to solid wood or laminated solid wood.

BRIEF DESCRIPTION OF THE INVENTION

The present invention thus relates to a process for treating a solid wood or laminated solid wood article so as to fixate thereto and/or therein a substance which, in its fixated form, modifies one or more properties of the article; wherein the article is treated, in a liquid preferably aqueous medium, comprising:

A substance which, via oxidative radical formation, undergoes a polymerization reaction and/or other covalent bond formation reaction leading to fixation of the resulting polymeric and/or covalently bound form of the substance on and/or within the wood.

An effective amount of an enzyme capable of catalyzing said oxidative radical formation.

An effective amount of an oxidizing agent appropriate for use in conjunction with the enzyme.

The substance which can undergo oxidative radical formation is preferably an organic substance, more particularly a substance of a type such that the fixated form(s) thereof:

Form(s) environmentally acceptable combustion products upon incineration or other combustion of the treated wood.

Is/are such that any species which derive from the fixated form(s) in question and which become released from the treated wood (e.g., as a consequence of the eventual fungal degradation thereof) are biodegradable in the surrounding environment.

It is moreover preferable that the substance is one which undergoes oxidative radical formation via reaction with the oxidizing agent employed in the process of the invention and under the catalytic influence of the enzyme employed in the process.

The substance may have an effect in itself (e.g., be a fungicide or a color substance) or the effect may appear upon the oxidative radical formation, the polymerization reaction and/or other covalent bond formation reaction. The enzyme treatment, however, causes a fixation by radical crosslinking or polymerization thereby enhancing the effect (e.g., fungicidal or color effect) by retaining the substance in the wood, and thus preventing or reducing leaks of the substance to the environment.

As discussed further in the following (vide infra), suitable oxidatively radicalizable substances include numerous phenolic substances (i.e., substances containing a phenolic hydroxy group) and aromatic amines.

DETAILED DESCRIPTION OF THE INVENTION

Wood

As already indicated, the process of the invention is well suited for the treatment (impregnation) of wooden articles manufactured from a variety of types of solid wood or laminated solid wood (the latter sometimes being referred to as "glulam"). The term "solid wood" as employed in the context of the invention denotes wood (whole wood) which after harvesting in nature has not undergone a comminution process and which thus retains the basic structure of wood as it occurs in nature. Thus, for example, products such as hardboard, fibreboard (e.g., "MDF"), chipboard, particle board and the like, all of which are manufactured from material prepared by comminution of wood are not within the scope of the term "solid wood" as employed herein. In this connection, wood veneer (i.e., wood in the form of a thin sheet or layer, normally of essentially uniform thickness, which has been cut from whole timber) is normally not to be regarded as encompassed within the scope of the term "solid wood" as employed in the present context.

Types of wood which are suitable for treatment in accordance with the invention include wood from various species of pine (genus Pinus), larch (genus Larix) and beech (genus Fagus), as well as wood from species such as Douglas fir (*Pseudotsuga menziesii*).

Although wood from species of spruce (genus Picea) is generally not satisfactorily receptive to impregnation by techniques employed hitherto (owing to its sapwood structure), it is contemplated that solid wood from such sources may be rendered receptive to impregnation in the manner according to the invention by including in the process a treatment of the wood with an enzyme, e.g., a pectinase (EC 3.2.1.15), which catalyzes a reaction capable of appropriately modifying the cellular (border pith) structure of the sapwood.

Enzymes

Enzyme classification numbers (EC numbers) referred to in the present specification with claims are in accordance with the *Recommendations* (1992) *of the Nomenclature Committee of the International Union of Biochemistry and Molecular Biology*, Academic Press Inc., 1992.

In principle, any type of enzyme capable of catalyzing oxidation of phenolic groups may be employed in the process of the invention. Preferred enzymes are, however, oxidases [e.g,. laccases (EC 1.10.3.2), catechol oxidases (EC 1.10.3.1) and bilirubin oxidases (EC 1.3.3.5)] and peroxidases (EC 1.11.1.7). In some cases it may be appropriate to employ two or more different enzymes in the process of the invention.

Suitable oxidases (in combination with which oxygen—e.g., atmospheric oxygen—is an excellent oxidizing agent) in the context of the present invention include laccases (EC 1.10.3.2).

Laccases are obtainable from a variety of microbial sources, notably bacteria and fungi (including filamentous fungi and yeasts), and suitable examples of laccases include those obtainable from strains of Aspergillus, Neurospora (e.g. *N. crassa*), Podospora, Botrytis, Collybia, Fomes, Lentinus, Pleurotus, Trametes (some species/strains of which are known by various names and/or have previously been classified within other genera; e.g. *Trametes villosa*=*T. pinsitus*=*Polyporus pinsitis* (also known as *P. pinsitus* or *P. villosus*)=*Coriolus pinsitus*), Polyporus, Rhizoctonia (e.g. *R. solani*), Coprinus (e.g. *C. plicatilis*), Psatyrella, Myceliopthora (e.g. *M. thermophila*), Schytalidium, Phlebia (e.g. *P. radita*; see WO 92/01046), or Coriolus (e.g. *C.hirsutus*; see JP 2-238885).

Preferred laccases in the context of the invention include laccases obtainable from *Trametes villosa* and from *Myceliophthora thermophila*, respectively.

Peroxidase enzymes (EC 1.11.1) employed in the method of the invention are preferably peroxidases obtainable from plants (e.g., horseradish peroxidase or soy bean peroxidase) or from microorganisms, such as fungi or bacteria. In this respect, some preferred fungi include strains belonging to the subdivision Deuteromycotina, class Hyphomycetes, e.g., Fusarium, Humicola, Trichoderma, Myrothecium, Verticillum, Arthromyces, Caldariomyces, Ulocladium, Embellisia, Cladosporium or Dreschlera, in particular *Fusarium oxysporum* (DSM 2672), *Humicola insolens, Trichoderma resii, Myrothecium verrucana* (IFO 6113), *Verticillum alboatrum, Verticillum dahlie, Arthromyces ramosus* (FERM P-7754), *Caldariomyces fumago, Ulocladium chartarum, Embellisia alli* or *Dreschlera halodes.*

Other preferred fungi include strains belonging to the subdivision Basidiomycotina, class Basidiomycetes, e.g., Coprinus, Phanerochaete, Coriolus or Trametes, in particular *Coprinus cinereus f. microsporus* (IFO 8371), *Coprinus macrorhizus, Phanerochaete chrysosporium* (e.g., NA-12) or *Trametes versicolor* (e.g., PR4 28-A).

Further preferred fungi include strains belonging to the subdivision Zygomycotina, class Mycoraceae, e.g., Rhizopus or Mucor, in particular *Mucor hiemalis.*

Some preferred bacteria include strains of the order Actinomycetales, e.g., *Streptomyces spheroides* (ATTC 23965), *Streptomyces thermoviolaceus* (IFO 12382) or *Streptoverticillum verticillium ssp. verticillium.*

Other preferred bacteria include *Bacillus pumilus* (ATCC 12905), *Bacillus stearothermophilus, Rhodobacter sphaeroides, Rhodomonas palustri, Streptococcus lactis, Pseudomonas purrocinia* (ATCC 15958) or *Pseudomonas fluorescens* (NRRL B-11).

Further preferred bacteria include strains belonging to Myxococcus, e.g. *M. virescens.*

Other potential sources of useful particular peroxidases are listed in B. C. Saunders et al., Peroxidase, London 1964, pp. 41–43.

Preferred peroxidases in the context of the invention include peroxidases classified under EC 1.11.1.7.

Determination of Laccase Activity

LAMU unit is the amount of enzyme that catalyzes the conversion of 1 $\mu$mole of syringaldazine to tetramethoxy-azo-bis-methylene-quinon per minute at the following analytical conditions: syringaldazine 16.5 $\mu$M, 20.3 mM Tris buffer, pH 7.50, incubated at 30° C., photometrically followed at 530 nm.

The enzyme dosage or activity can also be defined on a weight basis.

Oxidizing Agents

The enzyme(s) and oxidizing agent(s) used in the process of the invention should clearly be matched to one another, and it is clearly preferable that the oxidizing agent(s) in question participate(s) only in the oxidative reaction involved in the binding process, and does/do not otherwise exert any deleterious effect on the wood or other substances/materials involved in the process.

As already indicated, oxidases, e.g. laccases, are, among other reasons, well suited in the context of the invention since they catalyze oxidation by molecular oxygen. Thus, reactions which take place in vessels open to the atmosphere (or in other reaction vessels into which air—or for that matter another oxygen-containing gas—is introduced) and which involve an oxidase as enzyme will be able to utilize gaseous oxygen as oxidant; it may, however, be desirable to forcibly aerate the liquid medium during the reaction to ensure an adequate supply of oxygen.

In the case of peroxidases, hydrogen peroxide is a preferred peroxide in the context of the invention and is suitably employed in a concentration (in the liquid medium) in the range of 0.01–100 mM.

Impregnating Substances

The exact nature of a substance employed to impregnate wood in accordance with the invention will, of course, depend on the properties which the impregnation is intended to confer on the treated wood. For many purposes (e.g., achieving increased resistance to fungal degradation, or increased fire resistance), phenolic substances are very suitable. Certain types of phenolic substances are also suitable for modifying the color of wood.

Other classes of substances of relevance in the context of the invention include, as already mentioned, compounds comprising aromatic amine moieties.

Preferred substances includes cathecol, technical lignins (such as lignosulfonates, Kraft lignins and organosolv lignins) tannins, creosols, pyrolytic derivatives of wood, parabens (ethyl or propyl, methyl or butyl parahydroxybenzoate), gallic acid, benzoic acid or substituted forms thereof, ferullic acid, sinapic acid, 2-(4-thiazolyl) benzimidazole, 2-(thio-cyanomethyl-thio)phtalamide.

Liquid Medium

The liquid medium or mixture of liquids used in the process according to the invention should be matched to the composition is of enzyme, impregnating substance and oxidizing agent and the catalytic reaction as well as other process relevant properties. Without being limited to any theory it is presently contemplated that the suitability of a liquid medium depends on, inter alia, the mobility and/or solubility of the compounds, the reaction rate of enzyme and impregnation substance in the medium, the pH, the buffer, the possibility of applying the enzyme and the impregnating substance simultaneously and/or the medium ability to penetrate solid wood or laminated solid wood, e.g., by modifying the surface tension (see e.g., WO 95/00417 and WO 95/00418)

The liquid medium may be aqueous or a mixture of water and an organic solvent. Preferred solvents include dioxan, ethanol, methanol, glycerol, or mixtures thereof. The liquid medium may further comprise a surfactant.

pH in the Liquid Medium

Depending, inter alia, on the characteristics of the enzyme (s) employed, the pH in the liquid medium (aqueous or aqueous/organic medium) employed in the process of the invention will normally be in the range of 3–10, often preferably in the range 4–9.

Temperature in the Liquid Medium

In numerous embodiments of the process of the invention, temperatures in the range of 10–60° C., more preferably 20–40° C., will be employed.

Treatment Times

In numerous embodiments of the process of the invention, treatment times in the range of 5 minutes to 4 hours will be employed, depending, inter alia, on the type of wood to be impregnated, the temperature in the liquid treatment medium and the enzyme/oxidant/impregnating substance combination employed, and the pressure conditions employed. In many cases a treatment time in the range of 5–60 minutes will be suitable.

PROCEDURES FOR WOOD IMPREGNATION IN ACCORDANCE WITH THE INVENTION

The following, which is in no way intended to limit the scope of the present invention, describes some suitable general procedures for impregnating wood in accordance with the invention:

1. Procedures employing oxidase enzymes (enzymes using oxygen as oxidant), e.g., laccases 1.1. Impregnation at ambient pressure or under elevated pressure:

Wood articles (e.g., shaped articles such as posts, planks, joists, panels, window frames and the like, as already mentioned) are immersed in a solution (aqueous, aqueous/organic or organic) comprising one or more oxidases (e.g., a laccase, such as *Myceliophthora thermophila laccase* or *Trametes villosa laccase*) and the impregnating substance(s) (e.g., a fungicidal substance) to be introduced into the wood. An immersion time in the range of 5–120 minutes at ambient temperature will normally be employed, although about 5–60 minutes will often be most appropriate, particularly if the impregnation is performed at elevated pressure (e.g., a pressure in the range of 1.5–10 bar) in a suitable pressure vessel.

Irrespective of whether ambient or elevated pressure conditions are employed, it may be advantageous to carry out an initial impregnation of the wood articles in question using a solution—preferably a substantially oxygen-free solution—of the enzyme(s), and then carry out a subsequent impregnation of the articles with a solution containing the impregnating substance(s) and, optionally, further enzyme. Alternatively, immersion of the wood articles in a solution comprising both enzyme(s) and impregnating substance(s) may be carried out under substantially oxygen-free conditions (e.g., under an ambient or elevated pressure of an inert gas, such as nitrogen), after which atmospheric air (or, if appropriate, another oxygen-enriched gas, e.g., substantially pure oxygen) may be admitted to the vessel to bring about the oxidase-catalyzed oxidative coupling reactions which lead to fixation of the impregnating substance(s) on/within the wood. These latter modifications of the procedure will generally help to ensure that adequate fixation of the impregnating substance within the sapwood takes place.

1.2. Impregnation under reduced pressure:

When carrying out impregnation of wood articles under reduced pressure, it will normally be appropriate to initially subject the wood articles to immersion, under reduced pressure in an appropriate vessel, in a substantially oxygen-free aqueous, aqueous/organic or organic solution containing the enzyme(s) and the impregnating substance(s). An appropriate reduced pressure will suitably be one slightly above the pressure at which boiling of the solution in question will take place at the temperature employed (e.g., ambient temperature). Immersion times will suitably be within the ranges already mentioned under (1.1), above.

After completion of this initial immersion stage, atmospheric air (or, if more appropriate, another oxygen-enriched gas, e.g., substantially pure oxygen) may then be admitted to the vessel to bring about the oxidase-catalyzed oxidative coupling reactions leading to fixation of the impregnating substance(s) on/within the wood.

In all of the procedures outlined above, as well as in other embodiments of the process of the invention employing oxidase enzymes, the concentration of impregnating substance(s) in the solution will generally be in the range of 0.1–15 per cent by weight (% w/w), and the amount of solution employed will be normally be in the range of 1:1–20:1, preferably 1:5–15:1, on a weight basis relative to the weight of wood articles to be impregnated. The oxidase enzyme(s) employed will normally be present in an amount corresponding to 0.00001–1.0 mg of pure enzyme protein per gram of wood ($5\cdot10^{-6}$–5 LAMU/mL liquid), preferably 0.0001–1.0 or 0.001–1.0, e.g., 0.01–1.0 mg of pure enzyme protein per gram of wood.

2. Procedures employing peroxidase enzymes (enzymes which can use hydrogen peroxide as oxidant) under ambient pressure, elevated pressure or reduced pressure:

Wood articles (e.g., shaped articles such as posts, planks, joists, panels, window frames and the like, as already mentioned) are immersed in a solution (aqueous or aqueous/organic) containing hydrogen peroxide, one or more peroxidases (e.g. Cinereus coprinus peroxidase) and the impregnating substance(s) (e.g., a fungicidal substance) to be introduced into the wood. Immersion times, temperatures and, where appropriate, elevated pressure or reduced pressure conditions will generally be as described under "1.", above.

Irrespective of whether ambient, elevated or reduced pressure conditions are employed, it may be advantageous to carry out an initial impregnation of the wood articles in question using a solution containing only peroxidase(s) and impregnating substance(s), and then carry out a subsequent impregnation of the articles with a solution containing hydrogen peroxide and, optionally, further enzyme. Modification of the procedure in this manner will generally help to ensure that adequate oxidative coupling, and thereby fixation, of the impregnating substance on and/or within the sapwood takes place.

In the procedures outlined above, as well as in other embodiments of the process of the invention employing peroxidase enzymes, the concentration of impregnating substance(s) in the solution will generally be in the range of 0.1–15 per cent by weight (% w/w), and the amount of solution employed will be normally be in the range of 1:1–20:1, preferably 1:5–15:1, on a weight basis relative to the weight of wood articles to be impregnated. The peroxidase enzyme(s) employed will normally be present in an amount corresponding to 0.00001–1.0 mg of pure enzyme protein per gram of wood, preferably 0.0001–1.0 or 0.001–1.0, e.g., 0.01–1.0 mg of pure enzyme protein per gram of wood.

Irrespective of which conditions are employed, outlined in 1. and 2. above, the fixation reaction caused by the enzyme, the impregnating substance and the oxidizing agent impregnated in the wooden article could suitably be allowed to continue for 0.25–4 hours after immersion in the impregnating liquid before further processing.

FURTHER ASPECTS OF THE INVENTION

The above-described aspects of the invention relate to the enzyme-promoted fixation of various types of substances, such as substances derived from various phenolic compounds (e.g., phenols per se) or aromatic amine type compounds, on/in solid wood (or laminated solid wood) for the purpose, for example, of increasing the resistance of the wood to degradation (e.g., rot) caused by microorganisms, notably by fungi.

In the context of protection against fungal degradation, a main underlying concept of the invention as described above is exploitation of antifungal activity exerted by the fixated form(s) of the impregnating substance or substances. However, wood can in general be protected to a large extent against the onset of microbial—notably fungal—degradation by ensuring that the moisture content of the wood does not exceed some particular upper limit, e.g., about 20% w/w in the case of softwoods such as pine or spruce, and one way of achieving this is to reduce the tendency of a wood article to absorb moisture by increasing its "hydrophobicity".

Preliminary results indicate that it is possible to achieve increased "hydrophobicity" of whole wood or laminated whole wood articles by a process which is related to that already described herein, but which differs significantly therefrom by omitting a treatment with a substance which, via oxidative radical formation, will become fixated on/in the wood. The alternative process in question (which is also to be understood to be a process of the invention) thus comprises treating a solid wood or laminated solid wood article with: (a) an enzyme capable of catalyzing the oxidation of phenolic groups; and (b) an oxidizing agent appropriate for use in conjunction with the enzyme (i.e., an oxidizing agent which, in the presence of the enzyme, oxidizes phenolic groups).

The types and the amounts or concentrations of enzymes and oxidizing agents suitable for use in this alternative process, as well as the relevant process conditions (such as temperature, reaction time, pH in the reaction medium, etc.) will generally be as described above in connection with processes of the first type as described herein (i.e., processes of the invention which, in addition to treatment with an enzyme and an oxidizing agent, comprise a treatment with a radicalizable substance which is to be fixated on/in the wood).

In this alternative process of the invention, phenolic groups which become oxidized by the action of the enzyme and the oxidizing agent are believed to be phenolic groups present in the lignin part of the lignocellulose of the wood. Whilst the mechanism whereby an increase in the "hydrophobicity" (reduced tendency or ability to take up moisture) of a wood article treated in accordance with the process in question is achieved is not presently well understood, it is presently believed that enzyme-mediated reactions occurring on and/or close to the outer surface of the wood are to a large extent responsible herefor.

The present invention also relates to a treated wood product obtained or obtainable by a process according to the invention as disclosed herein.

The invention is illustrated by the following non-limiting examples.

EXAMPLE 1

IMPREGNATING SOLID WOOD WITH FUNGICIDES

Treatment of Samples:

In the following the procedure for incubation of solid blocks of beech (*Fagus sylvatica*) and scotch pine (*Pinus sylvestris*) with fungicidal substances is described. The experiments were made with or without laccase (*Myceliophthora thermophila*) present. In addition untreated control and laccase treated samples were made.

The wood blocks which measured 15×15×40 mm (approximately 10.5 grams) were incubated by vacuum in a 100 ml solution (0.1M phosphate buffer pH 7) of fungicidal substances with or without laccase added. The laccase dosage was 0.8 mg enzyme protein per g wood. Vacuum was applied immediately to the solution for 5 min. The vacuum was released and the samples were removed from the solution and left on a screen for 1 hour, allowing for fixation of the fungicidal substance under ambient conditions.

The incubated and control samples were placed in running tap water for 4 hours and air dried at 105° C. for 24 hours. The air dried samples were weighed and the weight was compared to the initial weight. The weight gain was calculated and reported in % weight increase compared to the initial weight. The impregnated samples were exposed to wood degrading fungi according to European standard EN 113. Following the exposure to wood degrading fungi, the samples were weighed and compared to the weight after incubation. The fungicidal effect was reported as % weight loss.

Applied Treatments:

Scotch Pine a) p-aminophenol 0.5% w/w
b) p-aminophenol 0.5% w/w+0.8 mg laccase protein per g wood.
c) Lignosulfonate 10% w/w.
d) Lignosulfonate 10% w/w+0.8 mg laccase protein per g wood.
e) Buffer solution only.
f) 0.8 mg Laccase protein per g wood only.

Beech a) Cathecol 5% w/w.
b) Cathecol 5% w/w+0.8 mg laccase protein per g wood
c) Buffer solution only
d) 0.8 mg laccase protein per g wood only Pine wood exposed to *Coniophora puteana*

| Treatment | Weight gain following incubation (% w/w) | Weight loss following fungi exposure (% w/w) |
|---|---|---|
| p-aminophel 0.5 % w/w | 3.5 | 8.4 |
| p-aminophenol 0.5 % w/w + laccase | 5.0 | 4.6 |
| Lignosulfonate | 7.5 | 5.0 |
| Lignosulfonate 10% w/w + laccase | 8.5 | 2.7 |
| Buffer solution only | 0 | 9.2 |
| Laccase only | 0 | 9.6 |
| Sterile control | 0 | 0 |

Beech wood exposed to *Coriolus versicolor*

| Treatment | Weight gain following incubation (% w/w) | Weight loss following fungi exposure (% w/w) |
|---|---|---|
| Cathecol 5% w/w | 3.3 | 19.8 |
| Cathecol 5% w/w + Laccase | 3.7 | 12.4 |
| Buffer solution only | 0 | 22.3 |
| Laccase only | 0 | 21.4 |
| Sterile control | 0 | 0 |

EXAMPLE 2

IMPREGNATING SOLID WOOD WITH COLOURING SUBSTANCES

Coloring of Solid Wood

In the following the procedure for coloring of solid blocks of scotch pine (*Pinus sylvestris*) by incubation with coloring substance and laccase (*Myceliophthora thermophila*) is described. The experiments were made with or without laccase present. In addition untreated control in buffer only and buffer+laccase treated samples were made.

The wood blocks which measured 15×15×40 mm (approximately 10.5 grams) were incubated by vacuum in a 100 ml solution (0.1M phosphate buffer pH 7) of coloring substance with or without laccase added. The laccase dosage was 0.8 mg/g wood. Vacuum was applied immediately to the solution for 5 min. The vacuum was released and the samples were removed from the solution. The incubated and control samples were placed in running tap water for 4 hours and air dried at 105° C. for 24 hours.

The color change was quantified by LAB values of the visible spectrum measured using a Minolta CR-300 cromameter.

| Treatment | Untreated L/A/B | | | Laccase treated L/A/B | | |
|---|---|---|---|---|---|---|
| Control buffer only | 84.6 | 3.8 | 21.0 | 81.1 | 4.1 | 24.4 |
| Cathecol 5% (w/w) | 82.3 | 3.7 | 24.0 | 72.2 | 5.3 | 19.8 |
| p-aminophenol 0, 5% (w/w) | 75.1 | 7.5 | 36.0 | 52.0 | 11.7 | 16.4 |
| Gallic acid 3% (w/w) | 80.3 | 4.9 | 26.4 | 55.9 | 6.4 | 25.1 |
| 2-chlor phenylendiamine 0, 3% (w/w) | 72.8 | 10.5 | 37.8 | 58.3 | 11.4 | 35.5 |

The results show a clear coloring effect of adding laccase to the coloring substance. When comparing the effect of the coloring substances only to a laccase treatment, only a minor coloring effect is initiated by the autooxidation of the coloring substances.

The coloring effect of laccase is caused by a polymerization and fixation of the coloring substances in the wood.

Note that the coloring effect may coincide with a preservative effect.

What is claimed is:

1. A process for impregnating and/or coloring a solid wood article to modify one or more properties of the article, said process comprising treating the article in a liquid medium comprising:

(a) a substance which, via oxidative radical formation, undergoes a covalent bond formation reaction leading to fixation of the resulting form of the substance on and/or within the solid wood article;

(b) an effective amount of an enzyme capable of catalyzing the oxidative radical formation; and (c) an effective amount of an oxidizing agent appropriate for use in conjunction with the enzyme.

2. The process according to claim 1, wherein the enzyme is selected from the group consisting of oxidases and peroxidases.

3. The process according to claim 1, wherein the enzyme is an oxidase and the oxidizing agent is oxygen.

4. The process according to claim 1, wherein the enzyme is a laccase obtained from a fungus selected from the group consisting of Myceliophthora species and Trametes species.

5. The process according to claim 2, wherein the enzyme is a laccase which is used in an amount in the range of 0.0001–1.0 mg of pure enzyme protein per gram of wood.

6. The process according to claim 1, wherein the enzyme is a peroxidase and the oxidizing agent is hydrogen peroxide.

7. The process according to claim 6, wherein the peroxidase is used in an amount in the range of 0.0001–1.0 mg of enzyme protein per gram of wood, and the initial concentration of hydrogen peroxide in the medium is in the range of 0.01–100 mM.

8. The process according to claim 1, wherein the substance is selected from the group consisting of phenolic compounds and compounds comprising aromatic amine moieties.

9. The process according to claim 8, wherein the substance is cathecol, a lignin, a tannin, creosol, a pyrolytic derivative of wood, a paraben, gallic acid, benzoic acid or substituted forms thereof, ferullic acid, sinapic acid, 2-(4-thiazolyl)benzimidazole, or 2-(thio-cyanomethyl-thio) phtalamide.

10. The process according to claim 1, wherein the substance is present in the liquid medium in an amount in the range of 0.1–10% by weight, based on the weight of dry wooden article.

11. The process according to claim 1, wherein the amount of the liquid medium employed is in the range of 1:1–20:1 on a weight basis relative to the weight of wood articles to be impregnated.

12. The process according to claim 1 performed as a pressure impregnation process.

13. The process according to claim 1 performed as a vacuum impregnation process.

14. The process according to claim 1, wherein the liquid medium has a pH between 3–10.

15. The process according to claim 1, wherein the treatment is conducted at a temperature between 10–60° C.

16. The process according to claim 1, wherein the treatment is conducted for a period of 5–240 minutes.

* * * * *